United States Patent [19]

Fujiki et al.

[11] Patent Number: 4,966,626

[45] Date of Patent: Oct. 30, 1990

[54] SINTERED FERRO ALLOY HAVING HEAT AND WEAR RESISTANCE AND PROCESS FOR MAKING

[75] Inventors: Akira Fujiki; Yoshiteru Yasuda, both of Kanagawa; Hiroyuki Endo, Chiba; Yutaka Ikenoue, Chiba; Keitaro Suzuki, Chiba, all of Japan

[73] Assignees: Nissan Motor Company, Limited, Yokohama; Hitachi Powdered Metals Company, Limited, Matsudo, both of Japan

[21] Appl. No.: 373,053

[22] Filed: Jun. 28, 1989

[30] Foreign Application Priority Data

Jun. 28, 1988 [JP] Japan ..... 63-158199

[51] Int. Cl.[5] ..... C22C 29/04

[52] U.S. Cl. ..... 75/238; 75/230; 75/236; 75/243; 75/244; 75/246; 419/11; 419/12; 419/16; 419/38

[58] Field of Search ..... 419/12, 11, 38, 16; 75/244, 238, 230, 236, 243, 246

[56] References Cited

U.S. PATENT DOCUMENTS

| | | | |
|---|---|---|---|
| 4,446,196 | 5/1984 | Brown | 428/544 |
| 4,648,903 | 3/1987 | Ikenoue et al. | 75/230 |
| 4,778,522 | 10/1988 | Maki et al. | 75/238 |
| 4,844,024 | 7/1989 | Fujiki et al. | 123/188.5 |

*Primary Examiner*—Stephen J. Lechert, Jr.
*Assistant Examiner*—Leon Nigohosian, Jr.
*Attorney, Agent, or Firm*—Foley & Lardner, Schwartz, Jeffery, Schwaab, Mack, Blumenthal & Evans

[57] ABSTRACT

A sintered ferro alloy comprises 5 to 25 wt % of one or two elements selected from Mo and W, 2 to 10 wt % of Cr, 0.1 to 0.9 wt % of Si, less than or equal to 0.7 wt % of Mn, less than or equal to 0.05 wt % of P, 0.5 to 2.0 wt % of C, 0.5 to 2.0 wt % of B, 0.1 to 7.0 wt % of at least one element selected from borides of La, Ce, Nd, Sm, Eu, Gd, Yb, Y or Sc, residual Fe, and contaminants. Also the alloy may comprise less than or equal to 20 wt % of at least one element selected from V, Nb, Ta, Ti, Zr, Hf, Co or Ni, if necessary. The alloy is produced by mixing the above mentioned components and pressurizing them in an Fe matrix, then sintering the pressurized mixture at 1150° C. to 1260° C. for 60 min. and reheating after sintering. This alloy has wear and heat resistance and can be utilized as valve seats for internal combustion engines in automotive vehicles.

17 Claims, No Drawings

SINTERED FERRO ALLOY HAVING HEAT AND WEAR RESISTANCE AND PROCESS FOR MAKING

BACKGROUND OF THE INVENTION

1. Technical Field

This invention relates to a sintered ferro alloy utilized in parts which require high heat and wear resistance at high temperatures. Specifically, this invention relates to a sintered ferro alloy as utilized in the valve seats or the valve faces of internal combustion engines in automotive vehicles.

2. Background Art

These days, the demand for higher speed and greater power from automotive internal combustion engines is greater than ever. Consequently, the wearing of valve parts of internal combustion becomes a more and more significant problem. Specifically, high endurance of the valve seats installed at the intake and the exhaust portions of the engine become necessary because the inner portions of the engine operate at such high temperatures.

Generally, a valve seat is subjected to high temperatures, and is struck at high speed, therefore it is necessary for a valve seat to have excellent heat and wear resistance, pitting resistance, and precise mating with corresponding parts such as valve faces.

In view of the aforementioned background, inventors of the present invention have already disclosed a ferro alloy for utilization in internal combustion engines in Japanese Patent First Publication No. 63-109142. In this alloy, amounts of carbide microparticles, borides and/or borides containing carbon are dispersed uniformly into an Fe matrix. Also rare earth elements such as La, Ce, Nd are dispersed in the matrix.

This ferro alloy has components as follows; 7 to 25 wt % of one or two elements selected from Mo and W, 2 to 10 wt % of Cr, 0.1 to 0.9 wt % of Si, less than or equal to 0.7 wt % of Mn, less than or equal to 0.05 wt % of P, 0.5 to 2.0 wt % of C, 0.5 to 2.0 wt % of B, 0.1 to 5 wt % of at least one element selected from rare earth elements such as La, Ce, Nd, Sm' Eu, Gd, Yb, Y, Sc and/or 0.3 to 7 wt % of at least one compounds selected from oxides of rare- earth elements-- such as La, Ce, Nd, Sm, Eu, Gd, Yb, Y, Sc, and if necessary, has less than or equal to 20 wt % of at least one element selected from V, Nb, Ta, Ti, Zr, Hf, Co, Ni, and residual Fe and contaminants in order to obtain desired composition.

The ferro alloy previously mentioned has good resistance to heating and wearing, and has a high degree of hardness to resist deforming to insure a good fit with corresponding parts such as valve faces. But further strength is required in this kind of ferro alloy.

Therefore, it is the object of the present invention to provide a sintered ferro alloy which can be used for valve seats in internal combustion engines having further resistance to heating and wearing.

SUMMARY OF THE INVENTION

This invention relates to a ferro alloy which can be utilized for valve seats in internal combustion engines for automotive vehicles.

The ferro alloy is composed from one or two elements of Mo and W, Cr, Si, Mn, P, C, B, at least one compound of borides of La, Ce, Nd, Sm, Eu, Gd, Yb, Y, Sc and if necessary, at least one element of B, Nb, Ta, Ti, Zr, Hf, Co, Ni, and residual Fe and contaminants.

By using boride compounds specifically hexaboride compounds, of rare earth elements, the heat and wear resistance of the ferro alloy is raised substantially.

DESCRIPTION OF THE INVENTION

The following is a discussion concerning the detail of the preferred embodiment according to the present invention.

It has become increasingly necessary for valve seats to have more and better resistance against heat and wear. The inventors take advantage of the good heat and wear resistance of boride compounds of rare earth elements, specifically, hexaboride compounds of same.

In the present invention, a sufficient amount of carbide microparticles, borides containing the above-mentioned boride compounds, preferably hexaboride compounds, and/or borides carbon containing borides are dispersed uniformly in an Fe matrix. This mixture indicates excellent resistance to heating and wearing when utilized in valve parts such as valve seats and faces for an automotive vehicle's internal combustion engine, for example.

The range or amount of each component of the alloy is determined as follows:

Mo and W:

Mo and W, cooperate with the Fe or Cr in the mixture to form the complex of carbide, boride or carbon containing boride by binding with B and C. These boride compounds give wear resistance to the alloy. This complex is dispersed in the matrix forming a solid solution and has the effect of strengthening the matrix and enhancing its temper hardening ability. But these effects are not obtained when using less than 5 wt % of Mo and/or W, as its wear resistance becomes poor. Further improvement of resistance is not obtained when using more than 25 wt % of Mo and/or W however the production costs become higher. Therefore, the amounts of Mo and/or W was determined in the range of 5 to 25 wt %, in total, regardless of the ratio of Mo to W.

Cr:

Cr forms the complex of carbide or boride in cooperation with Mo and/or W. It has the effect of increasing the wear resistance and concurrently enhances the hardenability of the solid solution during quenching. Furthermore, it enhances the final temper hardening ability and the corrosion resistance of the finished alloy. The desired effects of the above-mentioned are not obtained when using less than 2 wt % of Cr. Further improvements are not obtained when using more than 10 wt %. Moreover, more than 10 wt % of Cr decreases the mechanical strength and increases the potential for erosion against corresponding parts. Therefore, the amount of Cr was determined in the range of 2 to 10 wt %.

Si:

Si is included as a deoxidizing agent as excessive oxidation of particles reduces sinterability. When using less than 0.1 wt % of Si, it is not as a deoxidizer, furthermore, coarse particles of the $M_2C$ type carbide tend to separate from the blend resulting in decreased surface uniformity when formed into finished articles. On the other hand, significant increase in deoxidizing effect is not obtained when using more than 0.9 wt % of Si. Also particle rounding occurs above this level which results in decreased moldability of the finished alloy. Therefore, the optimal amount of Si was determined in a range of 0.1 to 0.9 wt %.

Mn:

Mn can also be included as a deoxidizer. It raises the sinterability of the alloy by neutralizing oxidants contained in the particles. However particle rounding also occurs when using concentrations of Mn greater than 0.7 wt %. Therefore, if added, the amount of Mn was determined at less than or equal to 0.7 wt %.

P:

In the art of wear resisting sintered ferro alloys, it is well known that 0.2 to 0.8 wt % of P is added to promote sintering. In the case of the present invention, when using more than 0.05 wt %, the boride or carbon containing boride complex tends to coarsen resulting in decreased surface uniformity of finished articles. Concurrently, network-like complexes of boride or carbon containing boride separate from the whole resulting in decreased strength of the alloy, more particularly, decreased the pitting resistance under high pressures. Therefore, the amount of P was determined at less than or equal to 0.05 wt %.

C:

Portions of C combining with carbide forming elements such as Mo, W, Cr, V make for improved wear resistance. Residual C forms a solid solution in the matrix and gives hardness and strength to the alloy even at high temperatures. Effects of the above-mentioned are not obtained sufficiently when using less than 0.5 wt % of C. On the other hand, if the amount of carbide complex is increased excessively, the particles coarsen, resulting in decreasing surface uniformity when formed into finished articles when using more than 2.0 wt % of C. Therefore, the optimal amount of C was determined at range of 0.5 to 2.0 wt %. It is necessary for C to be added in the form of atomized alloy particles of vacuum anealed Fe—Mo—W—Cr—Si—(V)—(Mn)—(Co)—C. If C is added as merely graphite, it will combine with boron sources such as Fe—B or Fe—Cr—B which are added later. This would result in the separation of coarse network-like particles of carbon containing boride which would form on the surface of the alloy. It would cause articles formed of the alloy to abrade against the surface of corresponding parts such as valve faces.

B:

B is one of the most important components of the invention. B forms a complex of borides in cooperation with Mo, W, V, Cr and Fe in the alloy components. It gives excellent heat and wear resistance and improves the hardenability of the alloy by forming a solid solution in the matrix. Additionally, B allows borides of La, Ce, Nd, Sm, Eu, Gd, Yb, Y and Sc to bind with the matrix, resulting in strengthening the alloy. Furthermore, portions of the above-mentioned boride complex and/or portions of the borides of rare earth elements also combines with C resulting in the formation of carbon containing borides and promotes resistance to heating and wearing.

The effects of the above-mentioned are not obtained sufficiently when using less than or equal to 0.5 wt % of B, and further improvement is not obtained when using more than or equal to 2.0 wt %. Therefore, the amount of B was determined at a range of 0.5 to 2.0 wt %.

Borides of La, Ce, Nd, Sm, Eu, Gd, Yb, Y, and Sc:

Borides of La, Ce, Nd, Sm, Eu, Gd, Yb, Y, and Sc have great hardness and high stability at high temperatures. They work dispersing particles in the alloy of the invention, promoting heat and wear resistance, portions of the borides dissociate when sintering. Rare earth elements which dissociate from borides in the matrix are concentrated at the surface of the alloy as the temperature raises higher. They then associate with Fe, Cr and so forth to form an oxidated surface coating having good heat resistance. Furthermore, these borides, activated by sintering, prevent coarsening of crystalline particles or carbides. Specifically, hexaboride compounds of these rare earth metals are strongly stable at high temperatures, and their benefit as dispersing particles to raise heat resistance is great. However, their effect is not substantially obtained when using less than 0.1 wt % thereof, further effects are not obtained nor is it economical to increase more than 7.0 wt %. Therefore, the determined range of these borides is between 0.1 to 7.0 wt % in total of at least one of the mentioned borides. They may be added in the form of an atomized alloy of Fe—Mo—W—Cr—(V)—Si—(Mn)—(Co)—rare earth borides—C in the matrix. Or they may be added separately as boride particles.

V, Nb, Ta, Ti, Zr, Hf, Co, Ni:

These elements are effective in promoting wear and corrosion resistance.

(V, Nb, Ta)

V, Nb and Ta form an extra hard carbide complex when combined with Fe and Cr. They give wear resistance to the alloy by forming complexes of carbides or borides in which they substitute for portions of Mo or W. They also strengthen the matrix by forming a solid solution in it, enhancing temper hardening. V, Nb and Ta also prevent coarsening of crystalline particles or carbides while sintering. These effects are not recognized substantially when using less than 0.5 wt % of V, Nb or Ta. Further improvement is not obtained by using more than 8.0 wt % of them. Therefore, if added, the optimal range was determined to be from 0.5 to 8.0 wt %.

(Ti, Zr, Hf, Co)

Ti, Zr, Hf and Co are boride forming elements. They may be added as needed in a range less than or equal to 12 wt %. Co particularly forms a boride complex by substituting for such as Mo or W. Concurrently, is raises hardness at high temperatures by forming a solid solution in the matrix. Therefore, it is preferably added when wear resistance at high temperatures is necessary.

(Ni)

When adding Ni, the tenacity of the matrix and its wear resistance are improved. Addition of Ni is specifically effective when using the alloy for parts subjected to severe wearing at high temperatures such as the valve seats of diesel engines. However, when using excessive amounts of B, Nb, Ta, Ti, Zr, Hf, Co or Ni, mating ability corresponding parts is decreased, due to lower surface uniformity of the alloy. Concerning this and the economic standpoint, total amounts of these elements were determined at less than or equal to 20 wt %.

EXAMPLE

The preferred embodiments of sintered ferro alloys having heat and wear resistance according to the present invention were compared with control alloys. A more detailed description will follow.

Embodiments 1 to 7, Controls 1 to 5

Materials used: −100 mesh sized particles of vacuum anealed atomized particles of Fe—-

Cr—Mo—W—Si—C alloy (V, Nb, Ta or Co added if necessary), −325 mesh size of Fe—Mo particles or pure Mo particles, −325 mesh size of Fe—W particles or pure W particles, −250 mesh size of Fe—B alloy particles (B=20 wt %), −250 mesh size of alloy particles such as Ferro-titanium, Ferro-zirconium, Ferro-hafnium, −325 mesh size of carbonil Ni particles. These particles were mixed. The ratio of components is shown in Table 1. After mixing, zinc stearate was added as a lubricant. Then the mixture was pressurized at 7 tonf/cm$^2$ in order to mold the mixing particles. Subsequently, the pressed mixture of particles was sintered under vacuum conditions at a temperature range of 1150° to 1260 ° C. for 60 min. After sintering, the mixture was reheated (quenched and tempered) and the forming processes for the alloys 1 to 7 (corresponding to the embodiments 1 to 7) and control alloys 1 to 5 were completed.

Embodiments 8 to 12, Controls 6 to 10

Materials used: −100 mesh sized particles of vacuum anealed atomized particles of Ge—Cr—Mo—W—Si—C alloy (B, Nb, Ta or Co added if necessary), −250 mesh size of boride particles of La, Ce, Nd, Sm, Eu, Gd, Yb, Y or Sc, −325 mesh size of Fe—Mo particles or pure Mo particles, −325 mesh size of Fe—W particles or pure W particles, −250 mesh size of Fe—B alloy particles (B=15 wt %), −250 mesh size of Fe—26 wt % P alloy part −250 mesh size of alloy particles such as Ferro-titanium, Ferro-zirconium, Ferro-hafnium, −325 mesh size of carbonil-Ni particles or so forth. These particles were mixed. The ratio of components is shown in Table 1. Then, zinc stearate was added as a lubricant. The mixture was pressurized at 7 tonf/cm$^2$ in order to mold the mixed particles. Subsequently, the pressed mixture of particles was sintered under vacuum conditions at a range of 1150° to 1260 ° C. for 60 min. After sintering, reheating (quenching and tempering) was performed, then embodiment alloys 8 to 12 and control alloys 6 to 10 were completed.

TABLE 1

R: residue

| Alloy | | Ratio of Components (wt %) | | | | | | | | | | | | | |
|---|---|---|---|---|---|---|---|---|---|---|---|---|---|---|---|
| | | Fe | Mo | W | Cr | Si | Mn | P | C | B | V | Nb | Ta | Ti | Zr |
| Embodiments | 1 | R | 12.0 | 2.0 | 3.0 | 0.2 | 0.3 | 0.01 | 0.8 | 0.9 | — | — | — | — | — |
| | 2 | R | 18.0 | 1.0 | 3.0 | 0.2 | 0.3 | 0.01 | 0.8 | 0.9 | — | 1.0 | — | 1.0 | 1.0 |
| | 3 | R | 9.0 | 9.0 | 4.0 | 0.3 | 0.2 | 0.01 | 1.0 | 0.8 | — | — | 1.0 | — | — |
| | 4 | R | 5.0 | 10.0 | 4.0 | 0.2 | 0.3 | 0.01 | 0.9 | 0.8 | — | 0.5 | 0.5 | — | — |
| | 5 | R | 12.0 | 2.0 | 3.5 | 0.2 | 0.3 | 0.01 | 0.8 | 0.8 | — | — | — | — | — |
| | 6 | R | 12.0 | 2.0 | 8.0 | 0.3 | 0.2 | 0.01 | 0.8 | 0.7 | — | — | — | 0.5 | — |
| | 7 | R | 12.0 | 2.0 | 7.0 | 0.3 | 0.4 | 0.01 | 0.9 | 0.8 | — | — | — | — | — |
| | 8 | R | 12.0 | 3.0 | 4.0 | 0.5 | 0.3 | 0.01 | 0.8 | 0.8 | — | — | 1.0 | — | — |
| | 9 | R | 12.0 | 3.0 | 3.0 | 0.3 | 0.6 | 0.01 | 0.9 | 0.8 | — | 0.5 | — | — | 0.5 |
| | 10 | R | 12.0 | 3.0 | 3.0 | 0.3 | 0.3 | 0.01 | 0.8 | 0.8 | 0.5 | 1.5 | — | 1.5 | — |
| | 11 | R | 12.0 | 3.0 | 3.0 | 0.3 | 0.2 | 0.02 | 0.8 | 0.8 | — | — | — | — | — |
| | 12 | R | 12.0 | 3.5 | 3.0 | 0.3 | 0.3 | 0.01 | 1.2 | 0.8 | — | — | 1.5 | — | — |
| Controls | 1 | R | 12.0 | 2.0 | 3.0 | 0.2 | 0.3 | 0.01 | 0.8 | 0.9 | — | — | — | — | 0.5 |
| | 2 | R | 18.0 | 1.0 | 3.5 | 0.2 | 0.3 | 0.01 | 0.9 | 0.8 | — | 1.0 | — | 1.0 | 1.0 |
| | 3 | R | 9.0 | 9.0 | 4.0 | 0.3 | 0.2 | 0.01 | 1.0 | 0.9 | — | — | 1.5 | — | — |
| | 4 | R | 5.0 | 10.0 | 4.0 | 0.3 | 0.2 | 0.01 | 0.9 | 0.8 | — | 0.5 | 1.0 | — | — |
| | 5 | R | 12.0 | 2.0 | 3.5 | 0.2 | 0.3 | 0.01 | 0.8 | 0.8 | — | — | — | — | — |
| | 6 | R | 12.0 | 3.0 | 4.0 | 0.5 | 0.3 | 0.01 | 0.8 | 0.8 | — | — | 1.0 | — | — |
| | 7 | R | 12.0 | 3.0 | 3.0 | 0.3 | 0.6 | 0.01 | 0.8 | 0.8 | — | 0.5 | — | — | 0.5 |
| | 8 | R | 12.0 | 3.0 | 3.0 | 0.3 | 0.3 | 0.01 | 0.8 | 0.8 | 0.5 | 1.5 | — | 1.5 | — |
| | 9 | R | 12.0 | 3.0 | 3.0 | 0.3 | 0.2 | 0.02 | 0.8 | 0.8 | — | — | — | — | — |
| | 10 | R | 12.0 | 3.5 | 3.0 | 0.3 | 0.3 | 0.01 | 1.2 | 0.8 | — | — | 1.5 | — | — |

| Alloy | | Ratio of Components (wt %) | | | | Wearing (mm) | | look of |
|---|---|---|---|---|---|---|---|---|
| | | Hf | Co | Ni | Rare earth borides | Valve seat | Valve | Valve |
| Embodiments | 1 | — | 2.0 | 1.0 | $LaB_4$:1.0, $CeB_4$:2.0 | 0.05 | 0.01 | Normal |
| | 2 | — | 3.0 | — | $NdB_4$:1.0, $SmB_4$:1.0 | 0.04 | 0.01 | Normal |
| | 3 | 1.5 | — | — | $CeB_4$:2.0, $GdB_3$:1.0 | 0.05 | 0.02 | Normal |
| | 4 | — | — | 0.5 | $ScB_2$:1.0, $EuB_6$:2.0 | 0.06 | 0.02 | Normal |
| | 5 | — | — | — | $ScB_2$:1.0 | 0.07 | 0.01 | Normal |
| | 6 | 2.0 | — | — | $YB_6$:2.0, $YbB_6$:1.5 | 0.03 | 0.02 | Normal |
| | 7 | — | — | — | $ScB_2$:2.0 | 0.08 | 0.03 | Normal |
| | 8 | 0.5 | — | — | $YB_6$:1.0, $LaB_6$:2.0 | 0.04 | 0.02 | Normal |
| | 9 | — | — | 1.5 | $EuB_6$:1.0, $ScB_2$:2.0 | 0.06 | 0.02 | Normal |
| | 10 | — | — | — | $CeB_6$:3.0 | 0.05 | 0.02 | Normal |
| | 11 | 1.0 | 2.0 | — | $LaB_6$:1.0, $EuB_6$:2.0 $YB_6$:1.5 | 0.03 | 0.01 | Normal |
| | 12 | — | — | 2.0 | $LaB_3$:2.0 | 0.07 | 0.03 | Normal |
| Controls | 1 | — | 2.5 | 1.0 | — | 0.37 | 0.05 | Normal |
| | 2 | — | 3.0 | — | $LaB_6$:5.0, $CeB_2$:12.0 | 0.52 | 0.15 | Pitting: Large |
| | 3 | 1.0 | — | — | $SmB_3$:4.0, $NdB_6$:10.0 | 0.35 | 0.30 | Pitting: Large |
| | 4 | — | — | 0.5 | $YbB_3$:0.03 | 0.43 | 0.21 | Normal |
| | 5 | — | — | — | $YB_6$:0.01, $GdB_3$:0.02 | 0.65 | 0.12 | Normal |
| | 6 | 0.5 | — | — | — | 0.50 | 0.18 | Normal |
| | 7 | — | — | — | — | 0.55 | 0.20 | Normal |
| | 8 | — | — | — | — | 0.40 | 0.45 | Pitting |
| | 9 | 1.0 | 2.0 | — | — | 0.31 | 0.40 | Pitting |
| | 10 | — | — | 2.0 | — | 0.40 | 0.38 | Normal |

<Wearing test>

Embodiment alloys 1 to 12 and Control alloys 1 to 10 as previously mentioned were formed as valve seats. Then, wearing tests were performed by using a valve/-valve seat test machine which duplicates conditions as produced in an actual vehicle. This machine heats a valve and a valve seat through combustion of propane gas, controlling the temperature automatically. It opens and closes the valve by driving an eccentric cam and renders state of wear of the valve seat when hit. The conditions of the test are shown in following Table 2.

TABLE 2

| Item | Conditions |
|---|---|
| Atmosphere | Propane gas combustion |
| Valve material | Inconel 751 |
| Valve temperature | 950° C. |
| Valve seat temperature | 500° C. |
| Stroke | 8.0 mm |
| Drive speed | 3500 rpm |
| Driving term | 100 hours |

The degree of wear of the valve seat and the valve was measured after the above mentioned test was performed. The measured results are also shown in Table 1.

The test was performed under high temperature and severe wearing conditions. Therefore, it is clear from the results shown in Table 1, that valve seats whose compositions ratios did not satisfy the ranges of the present invention (such as Control alloys 1 to 10) were subject to more extensive wearing of valve and the corresponding seat. Furthermore, pitting occurred on portions of the valve seat. So, they did not satisfy which are suitable for valves and valve seats.

On the other hand, the valve seats which were produced according to the present invention such as Embodiment alloys 1 to 12, incurred less wear to valves and valve seats and pitting did not occur.

Specifically, it was assured that alloys containing hexaborides of rare earth elements had excellent resistance to wearing compared with other alloys.

Although this invention has been shown and described with respect to detailed embodiments thereof, it will be understood by those skilled in the art that various changes in the form and detail thereof may be made without departing from the spirit and scope of the claimed invention.

What is claimed is:

1. A sintered ferro alloy having heat and wear resistance comprising:

5 to 25 wt % of at least one element selected from the group consisting of Mo and W,
2 to 10 wt % of Cr,
0.1 to 0.9 wt % of Si,
less than or equal to 0.7 wt % of Mn,
less than or equal to 0.05 wt % of P,
0.5 to 0.2 wt % of C,
0.5 to 0.2 wt % of B,
0.1 to 7.0 wt % of at least one boride of rare earth elements, and
residual Fe and contaminants.

2. The sintered ferro alloy as set forth in claim 1, wherein said alloy further comprises less than or equal to 20 wt % of at least one element selected from the group consisting of V, Nb, Ta, Ti, Zr, Hf, Co and Ni.

3. The sintered ferro alloy as set forth in claim 1, wherein said boride of rare earth elements is in the form of a hexaboride.

4. The sintered ferro alloy as set forth in claim 1, wherein said rare earth elements comprise at least one element selected from the group consisting of La, Ce, Nd, Sm, Eu, Gd, Yb, Y and Sc.

5. A valve seat which is formed from a sintered ferro alloy having heat and wear resistance, wherein said ferro alloy comprises:

5 to 25 wt % of at least one element selected from the group consisting of Mo and W,
2 to 10 wt % of Cr,
0.1 to 0.9 wt % of Si,
less than or equal to 0.7 wt % of Mn,
less than or equal to 0.05 wt % of P, 0.5 to 2.0 wt % of C,
0.5 to 2.0 wt % of B,
0.1 to 7.0 wt % of at least one boride of rare earth elements, and
residual Fe and contaminants.

6. The value seat as set forth in claim 5, wherein said alloy further comprises less than or equal to 20 wt % of at least one element selected from the group consisting of V, Nb, Ta, Ti, Zr, Hf, Co and Ni.

7. The valve set as set forth in claim 5, wherein said boride of rare earth elements is in the form of a hexaboride.

8. The valve seat as set forth in claim 5, wherein said rare earth elements comprise at least one element selected from the group consisting of La, Ce, Nd, Sm, Eu, Gd, Yb, Y and Sc.

9. A process for forming a sintered ferro alloy having heat and wear resistance, said process comprising the steps of:

mixing particles of 5 to 25 wt % of at least one element selected from the group consisting of Mo and W, 2 to 10 wt % of Cr, 0.1 to 0.9 wt % of Si, less than or equal to 0.7 wt % of Mn, less than or equal to 0.05 wt % of P, 0.5 to 2.0 wt % of C, 0.5 to 2.0 wt % of B, 0.1 to 7.0 wt % of at least one boride of rare earth elements,
pressurizing the mixture of particles in an Fe matrix,
sintering the pressurized particles at the temperature of 1150° C. to 1260° C. for 60 min., and
performing heat treatment of resultant sintered mixture.

10. The process for forming a sintered ferro alloy as set forth in claim 9, wherein said mixture of particles further comprises less than or equal to 20 wt % of at least one element selected from the group consisting of V, Nb, Ta, Ti, Zr, Hf, Co and Ni.

11. The process for forming a sintered ferro alloy as set forth in claim 9, wherein said boride of rare earth elements is mixed in the form of a hexaboride.

12. The process for forming a sintered ferro alloy as set forth in claim 9, wherein said rare earth elements comprise at least one element selected from the group consisting of La, Ce, Nd, Sm, Eu, Gd, Yb, Y and Sc.

13. The process for forming a sintered ferro alloy as set forth in claim 9, wherein said boride is added as atomized particles of a Fe—Mo—W—Cr—(V)—Si—(Mn)—(Co)—borides—C alloy.

14. The process for forming a sintered ferro alloy as set forth in claim 9, wherein said boride is added separately as boride particles.

15. The process for forming a sintered ferro alloy as set forth in claim 9, wherein said heat treatment comprises quenching and tempering of said resultant sintered mixture.

16. A sintered ferro alloy consisting essentially of the components recited in claim 1.

17. A valve seat which is formed from a sintered ferro alloy, wherein said ferro alloy consists essentially of the components recited in claim 5.

* * * * *